US005495742A

United States Patent [19]

Dorsett

[11] Patent Number: 5,495,742

[45] Date of Patent: Mar. 5, 1996

[54] PRESS FOR HEMMING PANELS

[75] Inventor: Michael W. Dorsett, Weybridge, United Kingdom

[73] Assignee: D. V. Automation Limited, Surrey, United Kingdom

[21] Appl. No.: 162,041

[22] PCT Filed: Sep. 17, 1992

[86] PCT No.: PCT/GB92/01713

§ 371 Date: Dec. 3, 1993

§ 102(e) Date: Dec. 3, 1993

[87] PCT Pub. No.: WO93/05902

PCT Pub. Date: Apr. 1, 1993

[30] Foreign Application Priority Data

Sep. 27, 1991 [GB] United Kingdom ..... 9120627

[51] Int. Cl.[6] ..... B21J 9/18

[52] U.S. Cl. ..... 72/450; 29/243.58; 100/271; 100/280

[58] Field of Search ..... 72/450, 451, 380, 72/381, 403, 407, 323; 100/271, 281, 280; 29/243.58

[56] References Cited

U.S. PATENT DOCUMENTS

| | | | |
|---|---|---|---|
| 4,706,489 | 11/1987 | Dacey, Jr. | 72/450 |
| 5,005,398 | 4/1991 | Evans | 72/450 |
| 5,083,355 | 1/1992 | Dacey, Jr. | 72/450 |
| 5,272,905 | 12/1993 | Evans | 72/450 |

FOREIGN PATENT DOCUMENTS

| | | |
|---|---|---|
| 958671 | 5/1964 | United Kingdom . |
| WO89/09101 | 10/1989 | WIPO . |
| WO89/09102 | 10/1989 | WIPO . |
| WO89/09103 | 10/1989 | WIPO . |
| WO89/09100 | 10/1989 | WIPO . |

*Primary Examiner*—David Jones

*Attorney, Agent, or Firm*—Fay, Sharpe, Beall, Fagan, Minnich & McKee

[57] ABSTRACT

The invention relates to an apparatus for bending a flange into engagement with a workpiece. A bending tool is mounted on a tool holder connected to a stand by a linkage mechanism. The linkage mechanism includes a first link with its ends journalled on a pin on the tool holder and on a fixed pin on the stand, and a second link with its ends journalled on a pin on the tool holder and on a pin, the position of which in relation to the stand can be adjusted. A first drive member pivots the first link about its fixed pin and a second drive member moves the adjustable pin.

10 Claims, 6 Drawing Sheets

PRESS FOR HEMMING PANELS

BACKGROUND OF THE INVENTION

This invention relates to a press having a press tool and a drive mechanism, and in particular, but not exclusively, is concerned with what is known as "hemming" panels, such as automotive body panels.

FIGS. 1A to 1C of the accompanying drawings illustrate hemming of inner and outer panels. The marginal edge 30 of an outer panel 32 (part of which is shown) is initially upturned at about 90°, as shown in FIG. 1A, and is fixed in a jig. An inner panel 34 is then placed over the outer panel 32 and is fixed in the jig, such that the outer edge 36 of the inner panel 34 sits close to the bend between the outer panel 32 and its marginal edge 30. In a "pre-hemming" operation, the marginal edge 30 is bent over at approximately 45°, as shown in FIG. 1B. Then, in a "final hemming" operation, the marginal edge 30 of the outer panel 32 is pressed down flat under great pressure against the outer edge 36 of the inner panel 34, as shown in FIG. 1C.

The movement of the final hem tool is important. If the panel were to have straight edges, then movement of the tool in the direction marked 38 in FIG. 1B might be acceptable. However, many body panels have curved edges and in these cases it is desirable to use a curved final press tool to hem a large extent of a curve. However, if the tool moved in a direction 38 in the plane of the paper of FIG. 1B at one location along the edge of the panel, at other locations the movement would be inclined relative to the plane of the paper of FIG. 1B, and there would be undesirable movement between the tool and the marginal edge 30, which would produce an unsatisfactory result. For a satisfactory result, it is desirable that the final hem tool moves vertically, as shown by arrow 40 in FIG. 1B.

A press for performing the pre-hemming and final hemming operations is known from International Patent Application No. WO89/09101 and is illustrated in FIGS. 2 to 4 of the accompanying drawings.

Referring to FIGS. 2 to 4, a pre-hemming tool is illustrated at 5, and a final hemming tool is illustrated at 6. The pre-hemming tool 5 is mounted for movement by a parallelogram mechanism having axes 10, 11, 12, 13 and is driven by a hydraulic piston and cylinder arrangement 22 through a lever 16 pivoted about a fixed pivot 18 and through a linkage 28. The final press tool 6 is mounted on a parallelogram arrangement having axes 17, 18, 19, 20, and the lever 16 forms one of the linkages of this parallelogram arrangement. In FIG. 3, it can be seen that the line connecting the axes 11, 13 of the first parallelogram arrangement is generally at 60° to the horizontal, and therefore the movement of the pre-hemming tool 5 at this stage is approximately at 30° to the horizontal. In FIG. 4, it can be seen that the line connecting the axes 18, 20 of the second parallelogram arrangement is generally horizontal, and therefore the movement of the final hemming tool 6 at this stage is generally vertical.

A problem with the arrangement shown in FIGS. 2 to 4 is that the mechanical advantage between the final hemming tool 6 and the piston and cylinder arrangement 21 is roughly unity, and a piston and cylinder arrangement 21 must therefore be provided which can produce very large forces.

It is an object of the present invention to provide a press which does not need such a large operating force, which is compact, and preferably which can be powered by an electric motor.

SUMMARY OF THE INVENTION

In accordance with the present invention, a press comprises:

a lever pivoted about a first fixed pivot point;

first and second linkages pivoted about second and third pivot points, respectively, on the lever, the second pivot point being intermediate the first and third pivot points;

a third linkage pivoted about a fourth pivot point with respect to the second linkage and pivoted about a fifth pivot point;

a mechanism for moving the fourth pivot point;

a fourth linkage pivoted about the fifth pivot and pivoted with respect to the first linkage about a sixth pivot point; and a press tool mounted on the first linkage and facing in a direction generally parallel to the direction from the sixth pivot point to the second pivot point.

The press is arranged so that, as the press approaches a final pressing position of the press tool:

the fifth pivot point is fixed;

the press tool moves in a direction generally parallel to the direction from the sixth to second pivot points; and the third, fourth and fifth pivot points approach alignment.

By arranging that the third, fourth and fifth pivot points approach alignment as the mechanism approaches the final pressing position, the force applied by the mechanism for moving the fourth pivot point results in a greatly amplified force pushing the third pivot point away from the fifth pivot point. This latter force is then further amplified by the lever (because the second pivot point is between the first and third pivot points) and transmitted by the first linkage to the press tool.

Preferably, as the press approaches the final pressing position, the alignment of the third, fourth and fifth pivot points is generally parallel to the direction between the second and sixth pivot points. Thus, the lever and the first, second, third and fourth linkages approach a parallelogram configuration to produce a desirable final movement of the press tool.

Preferably, the mechanism for moving the fourth pivot point comprises a crank rotatable about a seventh pivot point, and a fifth linkage pivoted about an eighth pivot point with respect to the crank and pivoted about the fourth pivot point, and, as the press approaches the final pressing position, the fourth, seventh and eight pivot points approach alignment. Thus a drive torque applied to the crank can produce a high force on the fourth pivot point.

A further problem with the known arrangement shown in FIGS. 2 to 4 is that, before or after the hemming operation, when the machine is in the FIG. 2 position, the final tool 6 is above and only slightly to the side of the hem. Bearing in mind that all of the hemming of a pair of panels is desirably carried out at one time and therefore that final tools 6 will surround the panels, the known arrangement when in its initial/finish position severely restricts access for the panels.

The press of the present invention preferably further comprises: a sixth linkage pivoted about a ninth fixed pivot point and pivoted about the fifth pivot point; and an abutment (preferably adjustable) which limits the movement of the sixth linkage so that as the press approaches the final pressing position the fifth pivot point becomes fixed. Thus, the fifth pivot point can move before and after the final pressing stage so that the final press tool can be moved away to facilitate loading and unloading of the press with panels. In particular, and in the case where in the final pressing position the sixth pivot point is generally vertically above the second pivot point, a first cam element may be formed on the second linkage adjacent the third pivot point, and a second cam element may be provided beneath the third pivot point. As the press is moved away from the final pressing position the first cam element engages the second cam element to lift the third pivot point and thereby lift the lever and the second pivot point. Also, if the abutment is adjustable, it provides a simple and convenient way of adjusting the length of travel of the press tool.

The press of the present invention may be provided with a pre-pressing tool. In particular, the press may further conveniently comprise a seventh linkage pivoted about the first fixed pivot point; an eighth linkage pivoted about a tenth fixed pivot point; a ninth linkage pivoted about eleventh and twelfth pivot points with respect to the seventh and eight linkages, respectively, so that the seventh, eight and ninth linkages are arranged generally as a parallelogram; and a mechanism for moving the twelfth pivot point; the pre-pressing tool being mounted on the ninth linkage and arranged to engage a workpiece prior to engagement by the main press tool.

In order to achieve the desired movement of the pre-pressing tool, the arrangement may be such that a line from the first to the tenth pivot points rises at about 30° to the horizontal.

Conveniently, the mechanism for moving the twelfth pivot point may comprise an arm projecting from the eighth linkage; a tenth linkage pivoted to the arm at a thirteenth pivot point; and a second crank moving with the first crank and pivoted with respect to the tenth linkage at a fourteenth pivot point.

Although not shown in FIGS. 2 to 4, the piston and cylinder arrangements 21 of the known hemming press required large and expensive hydraulic control packs, and in view of space restrictions, these have in the past been mounted above the press, thus further hindering access. Also, maintenance of hydraulic systems can be expensive and messy. The press of the present invention enables an electric motor to be used for driving the first (and second) crank. Electric motors are clean and less expensive to maintain, and the controller therefor is less expensive and small in size.

DETAILED DESCRIPTION OF THE PREFERRED EMBODIMENT

A specific embodiment of the press according to the present invention will now be described by way of example with reference to FIGS. 5–8.

Figure 1A:
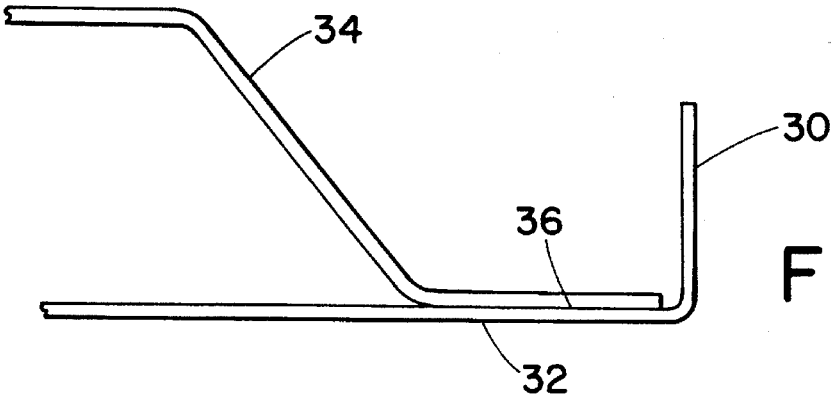
FIGS. 1A to 1C illustrate the process of hemming inner and outer panels.
Figure 1B:
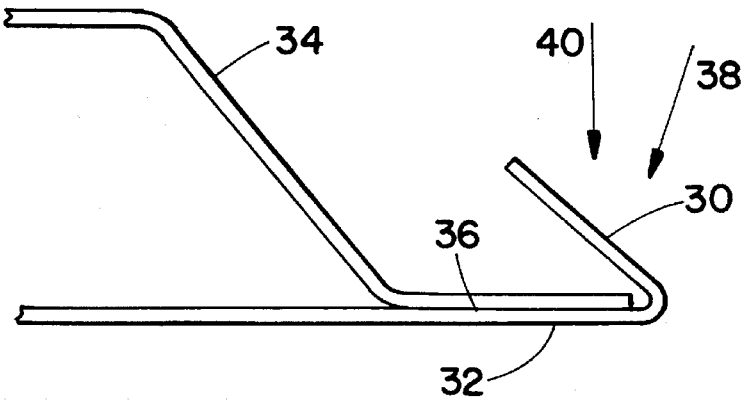
Figure 1C:
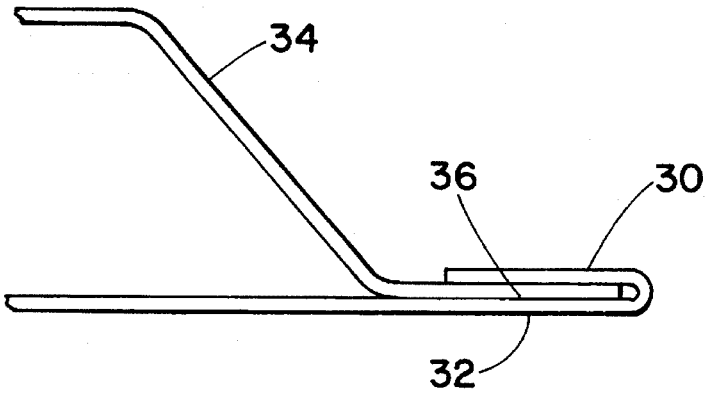
Figure 2:
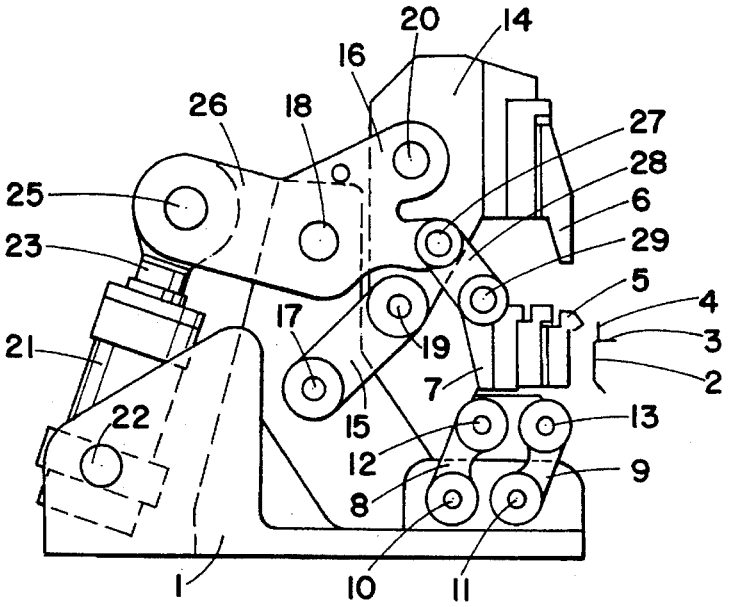
FIG. 2 (PRIOR ART)
FIG. 2 is a side view of the known press prior to a hemming operation.
Figure 3:
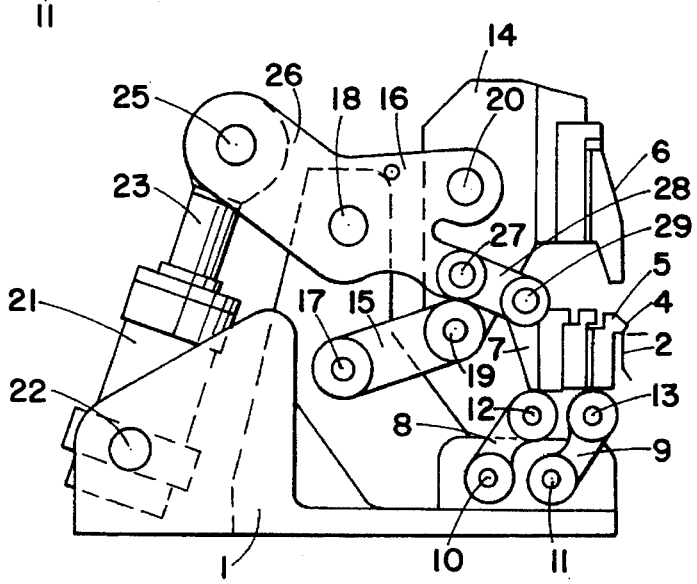
FIG. 3 (PRIOR ART)
FIG. 3 shows the press in its position at the end of the pre-hemming operation.
Figure 4:
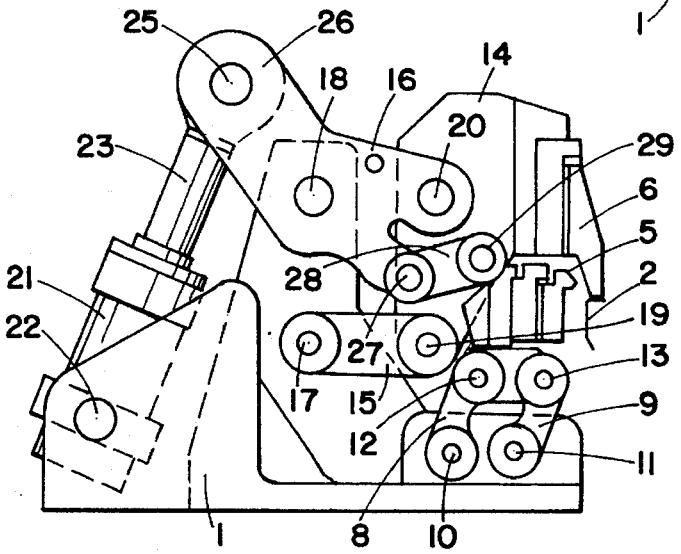
FIG. 4 (PRIOR ART)
FIG. 4 shows the press in its position at the end of the final hemming operation.
Figure 5:
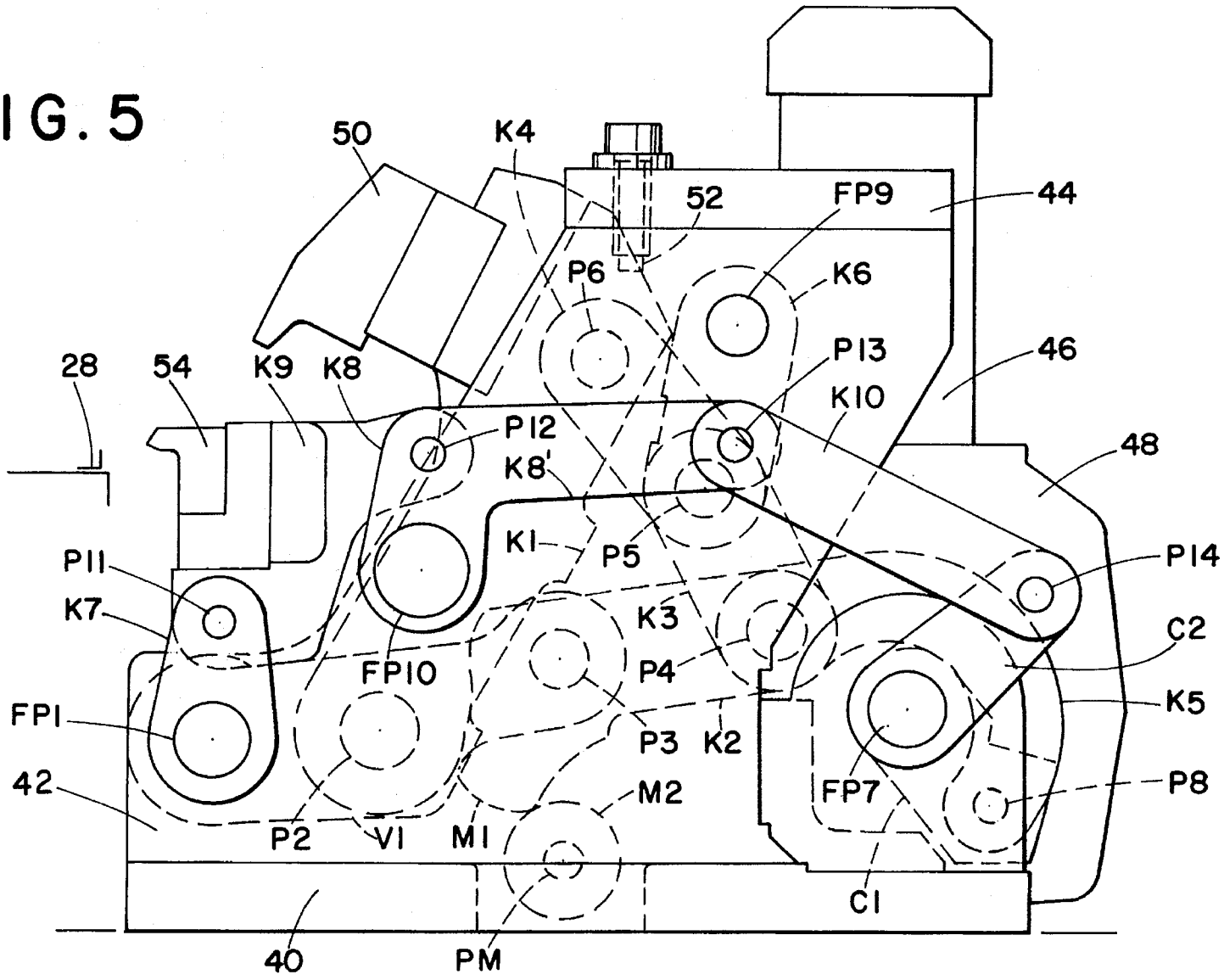
FIG. 5 is a partially cut-away side view of the press in its start position.

Referring to FIG. 5, the press has a frame which comprises a base 40 with a pair of side wall 42, only one of which is shown, and an upper wall 44. An electric motor 46 having a worm gearbox 48 is mounted on one of the side wall 42.

A number of fixed pivots are provided between the side walls 42 mounted on one or both of the side walls, namely fixed pivots FP1, FP9 and FP10. Also, the gear box 48 has an output shaft with a fixed axis FP7. A lever V1 extends generally to the right from the first fixed pivot FP1 and provides thereon second and third pivots P2, P3. A first linkage K1 is connected at the second pivot P2 and extends generally upwardly. A second linkage K2 is connected at the third pivot P3 and extends to a fourth pivot P4. A third linkage K3 is connected at the fourth pivot P4 and extends to a fifth pivot P5. A fourth linkage K4 is connected at the fifth pivot P5 and is also connected at a sixth pivot P6 to the first linkage K1. A sixth linkage K6 is connected at the fifth pivot P5 and is also pivoted at the ninth fixed pivot FP9. A crank C1 is mounted on the gearbox shaft FP7. A fifth linkage K5 is connected at an eighth pivot P8 to the crank C1 and is also connected to the fourth pivot P4. A final press tool 50 is mounted on the first linkage K1. An abutment 52 depends from the upper wall 44 and is screw threaded into the upper wall 44 so that the position of the abutment 52 can be adjusted. The lower end of the second linkage K2 is formed as a first cam element M1 for engagement with a second roller cam element M2 mounted for rotation about a fixed cam pivot PM beneath the third pivot P3.

A seventh linkage K7 is pivoted about the first fixed pivot FP1, and an eighth linkage K8 is pivoted about the tenth fixed pivot FP10. A ninth linkage K9 connects the seventh and eight linkages K7, K8 at eleventh and twelfth pivot points P11, P12, respectively, so that the seventh to ninth linkages K7, K8, K9 form a parallelogram arrangement. A pre-hemming tool 54 is mounted on the ninth linkage K9. The eighth linkage K8 has a projecting arm K8' which is connected at a thirteenth pivot P13 to a tenth linkage K10, which is pivoted at a fourteenth pivot P14 to a second crank C2 which is also fixed on the gearbox shaft FP7.

The following are examples of pivot-to-pivot linkage lengths, and of fixed positions relative to the panel edge. Of course, these figures may be scaled, and the linkages may be re-designed so that many other sets of figures will still provide the features and advantages of the invention:

| | | |
|---|---|---|
| | Fixed Positions | |
| Panel edge | | (0, 0) |
| First fixed pivot | FP1 | (95, −175) |
| Gearbox shaft | FP7 | (530, −155) |
| Ninth fixed pivot | FP9 | (415, 95) |
| Tenth fixed pivot | FP10 | (210, −65) |
| Second cam pivot | PM | (305, −255) |
| Adjustable abutment | 50 | (345, 132) to (345, 150) |
| | Pivot-to-Pivot Lengths | |
| Lever V1 | FP1 to P2 | 110 |
| | FP1 to P3 | 230 |
| First crank C1 | FP7 to P8 | 85 |
| Second crank C2 | FP7 to P14 | 110 |

-continued

| | | |
|---|---|---|
| First linkage K1 | P2 to P6 | 280 |
| Second linkage K2 | P3 to P4 | 145 |
| Third linkage K3 | P4 to P5 | 105 |
| Fourth linkage K4 | P5 to P6 | 110 |
| Fifth linkage K5 | P4 to P8 | 180 |
| Sixth linkage K6 | FP9 to P5 | 110 |
| Seventh linkage K7 | FP1 to P11 | 75 |
| Eighth linkage K8 | FP10 to P12 | 75 |
| | FP10 to P13 | 220 |
| | P12 to P13 | 200 |
| Ninth linkage K9 | P11 to P12 | 175 |
| Tenth linkage K10 | P13 to P14 | 220 |

FIG. 5 shows the start/finish position of the press, and it can be seen that the final hemming tool 50 is withdrawn well to the side of the hem area 28 to increase the access region for the panels.

Figure 6:
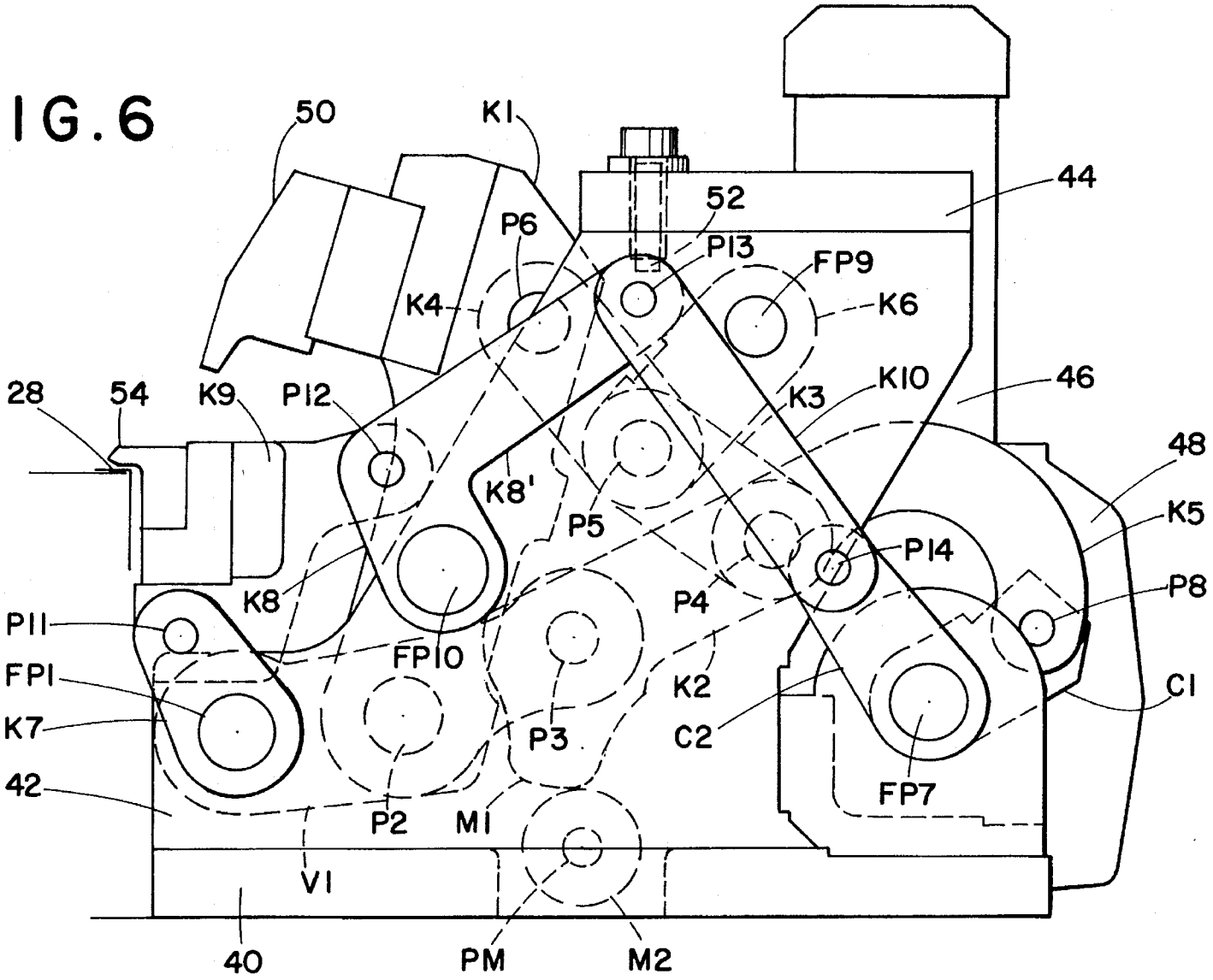
FIG. 6 is a view of the press at the pre-hemming stage.

In order to perform the hemming operations, the gearbox shaft FP7 is rotated counterclockwise. As this happens, the second crank C2 rotates counterclockwise, and the second crank C2 and tenth linkage K10 become more aligned. The eighth linkage K8 pivots around the tenth fixed pivot FP10 causing the parallelogram mounting of the pre-hemming tool 54 to rotate counterclockwise. A stage is reached, as shown in FIG. 6, in which the second crank C2 and tenth linkage K10 are aligned, the seventh and eighth linkages K7, K8 are generally at 60° to the horizontal, and the pre-hemming tool 54 is in its outermost position and has engaged the marginal edge of the outer panel and bent it through approximately 45°.

While the above-mentioned motion was proceeding, the first crank C1 was also being rotated counterclockwise, which through the fifth linkage K5 and the fourth pivot P4 caused the second and third linkages K2, K3 to become more aligned and also caused the sixth linkage K6 to rotate clockwise. Furthermore, with rotation of the second linkage K2 counterclockwise, the first cam element M1 rode clockwise around the second cam element M2, causing the third pivot P3 to rise slightly, thus through the lever V1 also causing the second pivot P2 to rise slightly. Also, with this motion, the first linkage K1 rotated slightly counterclockwise about the second pivot P2.

After the pre-hemming stage, and with continued counterclockwise rotation of the gearbox shaft FP7, the second and third linkages K2, K3 become more aligned. Also, the first cam element M1 rides over the second cam element M2, and the third pivot P3 begins to drop slightly. The first linkage K1 becomes vertical and the fourth and sixth linkages K4, K6 become aligned and the sixth linkage K6 bears against the abutment 52, as shown in FIG. 7, at about the same time as the final hemming tool 50 touches the marginal edge of the outer panel.

While the above-mentioned movement has progressed, the second crank C2 and the tenth linkage K10 have gone over centre, and therefore the thirteenth pivot P13 descends, causing the parallelogram mounting for the pre-hemming tool 54 to withdraw the tool 54 from the workpiece, so as not to clash with the final hemming tool 50.

Figure 7:
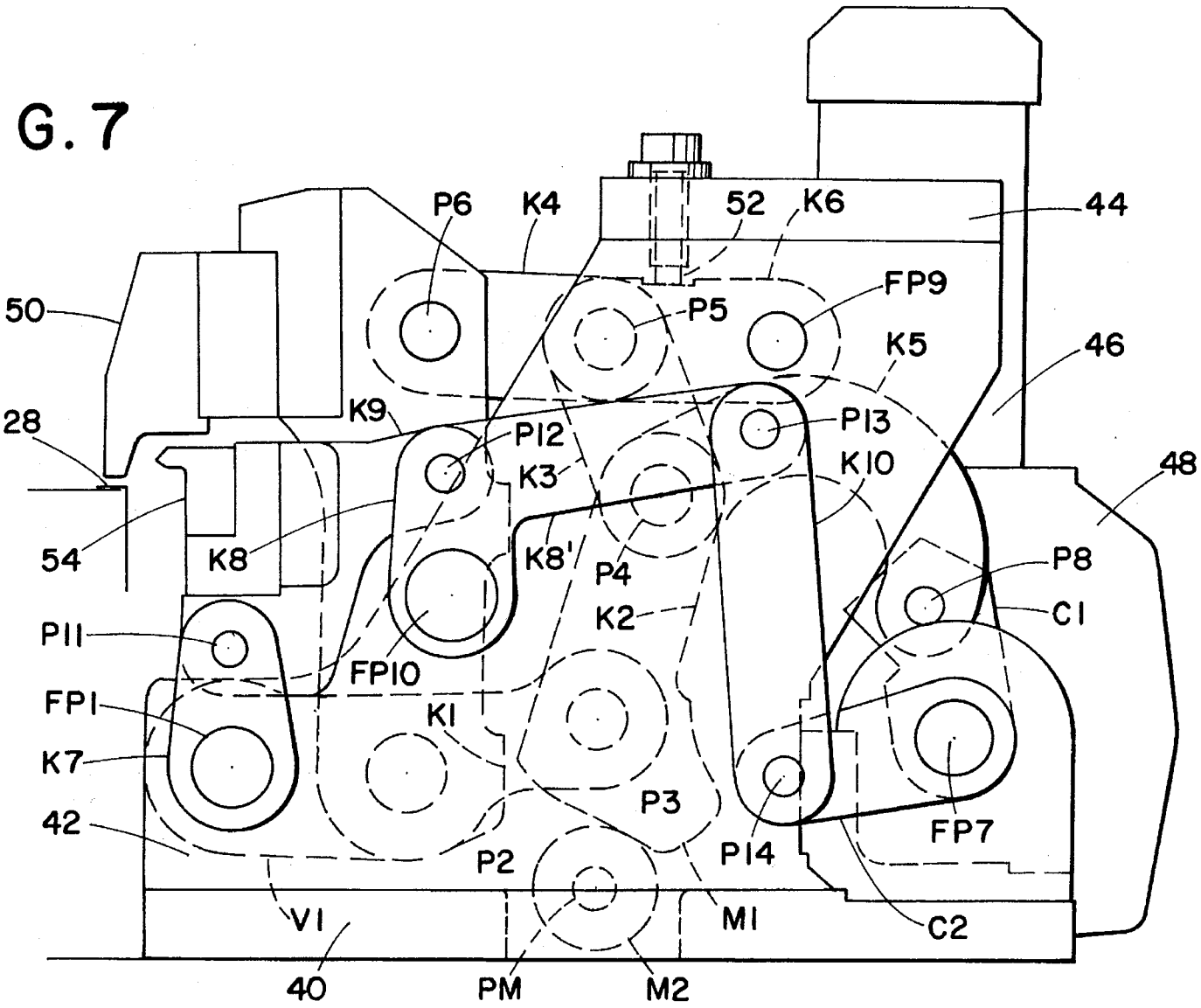
FIG. 7 is a side view of the press as the final hemming stage begins.

From the position shown in FIG. 7, continued counterclockwise movement of the first crank C1 caused by the gearbox shaft FP7 causes the shaft FP7, eighth pivot P8 and fourth pivot P4 to become, or almost to become, aligned. This movement also causes the third pivot P3, fourth pivot P4 and fifth pivot P5 to become, or almost to become, aligned. The fifth pivot P5 can move no further upwards, because the abutment 52 is engaging the sixth linkage K6. Also, the first cam element M1 is shaped so that at this stage, the first and second cam elements M1, M2 disengage. Therefore, as the second and third linkages K2, K3 become aligned, or almost aligned, the third pivot P3 is pushed downwardly by the second linkage K2 with great force. This force is amplified by the lever V1 to cause the first linkage K1 to be pulled downwardly with even greater force, so that the final hemming tool 50 is pulled downwardly with very large force. The final position is shown in FIG. 8.

It should be noted that the final position of the final hemming tool 50 is controlled by the adjustable abutment 52. If the abutment is adjusted downwardly, then the final tool 50 will have a greater downward travel, and vice versa.

Figure 8:
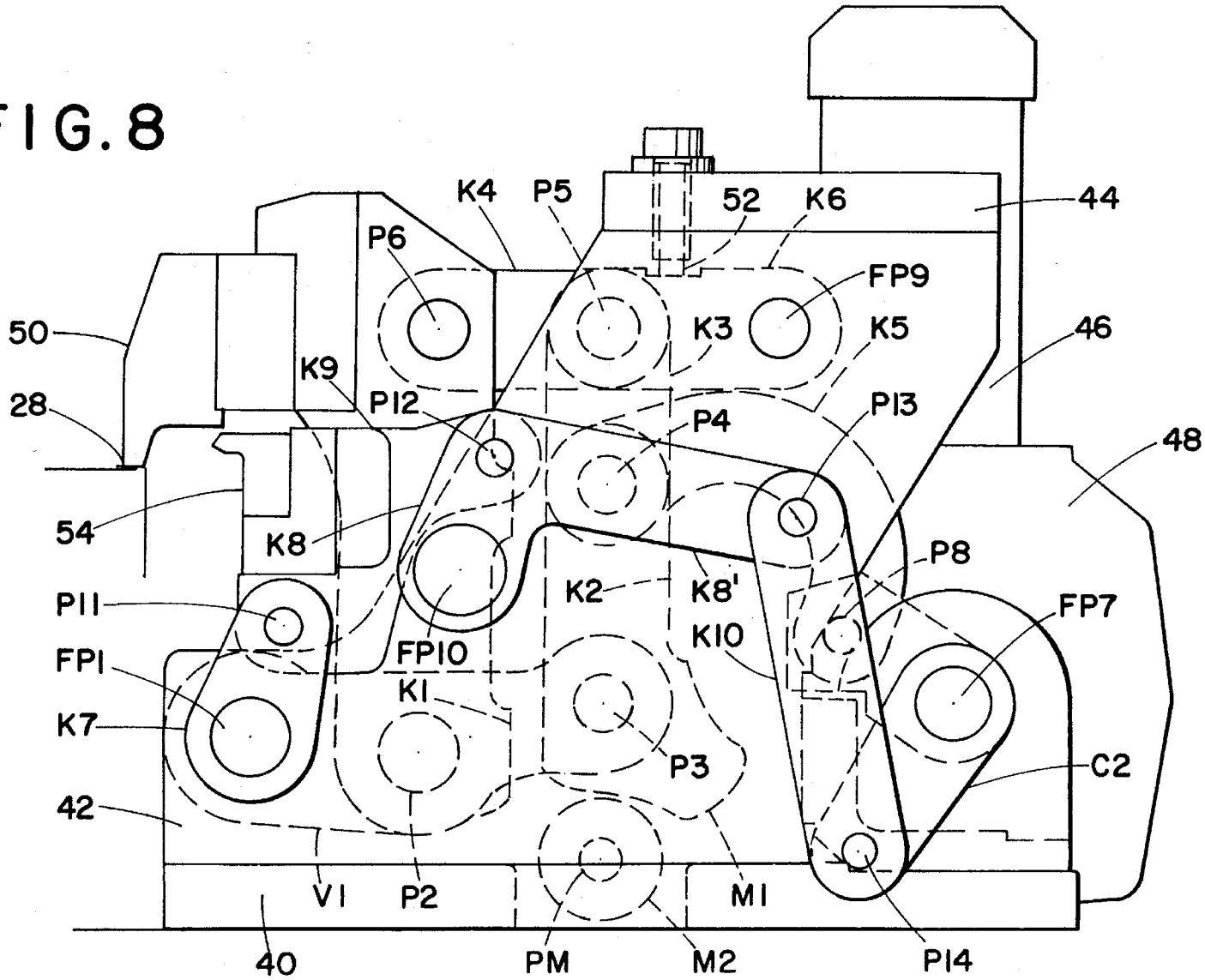
FIG. 8 is a side view of the press at the end of the final hemming operation.

From the position shown in FIG. 8, the machine may be returned to the position shown in FIG. 5 by reversing the electric motor 46. Alternatively, the machine could be redesigned so that continued counterclockwise rotation of the first and second cranks C1, C2 causes the machine to return to its start position.

It will be appreciated that many modifications and developments may be made to the press, and that the above description and the accompanying drawings are given by way of example only.

I claim:

1. A press comprising:

a frame;

a lever (V1) pivoted about a first fixed pivot point (FP1) on the frame;

first and second linkages (K1, K2) pivotally connected to the lever about second and third pivot points (P2, P3), respectively, the second pivot point (P2) being intermediate the first and third pivot points (FP1, P3);

a third linkage (K3) pivotally connected to the second linkage about a fourth pivot point (P4);

a mechanism (K5, P8, C1) for moving the fourth pivot point;

a fourth linkage (K4) pivotally connected to the third linkage about a fifth pivot point (P5) and pivotally connected to the first linkage about a sixth pivot point (P6); and a press tool (50) mounted on the first linkage and facing in a direction generally parallel to an axis intersecting the sixth pivot point and the second pivot point;

wherein, as the press approaches a final pressing position of the press tool:

the fifth pivot point is fixed relative to the frame;

the press tool moves in a direction generally parallel to the axis intersecting the sixth and second pivot points; and the third, fourth and fifth pivot points approach alignment.

2. A press as claimed in claim 1, wherein, as the press approaches the final pressing position, the alignment of the third, fourth and fifth pivot points is generally parallel to the axis intersecting the second and sixth pivot points.

3. A press as claimed in claim 1, wherein:

the mechanism for moving the fourth pivot point comprises a crank (C1) rotatable about a seventh point (FP7) on the frame, and a fifth linkage (K5) pivoted about an eighth pivot point (P8) with respect to the crank and pivoted about the fourth pivot point; and as the press approaches the final pressing position, the fourth, seventh and eight pivot points approach alignment.

4. A press as claimed in claim 1, further comprising:

a sixth linkage (K6) pivoted about a ninth fixed pivot point (FP9) on the frame and pivoted about the fifth pivot point; and an abutment (52) on the frame which limits the movement of the sixth linkage so that as the press approaches the final pressing position the fifth pivot point becomes fixed.

5. A press as claimed in claim 4, wherein the abutment is adjustable to vary the fixed position of the fifth pivot point.

6. A press as claimed in claim 4, wherein:

in the final pressing position, the sixth pivot point is generally vertically above the second pivot point (P2);

a first cam element (M1) is formed on the second linkage (K2) adjacent the third pivot point (P3);

a second cam element (M2) is provided on the frame beneath the third pivot point; and as the press is moved away from the final pressing position the first cam element engages the second cam element to lift the third pivot point and thereby lift the lever and the second pivot point.

7. A press as claimed in claim 1, further comprising:

a seventh linkage (K7) pivoted about the first fixed pivot point;

an eighth linkage (K8) pivoted about a tenth fixed pivot point (FP10) on the frame;

a ninth linkage (K9) pivotally connected about eleventh and twelfth pivot points (P11, P12) to the seventh and eighth linkages, respectively, so that the seventh, eighth and ninth linkages are arranged generally as a parallelogram;

a mechanism (K8, P13, K10, P14, C2) for moving the twelfth pivot point; and a pre-pressing tool (54) mounted on the ninth linkage and arranged to engage a workpiece (28) prior to engagement by the main aforementioned press tool.

8. A press as claimed in claim 7, wherein a line from the first to the tenth pivot points rises at about 30° to the horizontal.

9. A press as claimed in claim 7, wherein the mechanism for moving the twelfth pivot point comprises:

an arm (K8') projecting from the eighth linkage;

a tenth linkage (K10) pivotally connected to the arm at a thirteenth pivot point (P13); and a second crank (C2) moving with the mechanism and pivoted with respect to the tenth linkage at a fourteenth pivot point (P14).

10. A press as claimed in claim 1, further comprising an electric motor (46) for driving the mechanism.

* * * * *